United States Patent [19]

MacFee

[11] 4,078,278

[45] Mar. 14, 1978

[54] SLIDE FASTENER

[75] Inventor: Norman William MacFee, Conneaut Lake, Pa.

[73] Assignee: Textron Inc., Providence, R.I.

[21] Appl. No.: 674,008

[22] Filed: Apr. 5, 1976

[51] Int. Cl.[2] ..... A44B 19/04

[52] U.S. Cl. ..... 24/205.1 R; 24/205.13 R

[58] Field of Search ..... 24/205.1 R, 205.13 R, 24/205.13 D

[56] References Cited

U.S. PATENT DOCUMENTS

| | | | |
|---|---|---|---|
| 2,174,159 | 9/1939 | Marinsky | 24/205.1 R |
| 2,225,286 | 12/1940 | Poux | 24/205.13 R |
| 2,355,996 | 8/1944 | Morin | 24/205.13 R |
| 2,798,275 | 7/1957 | Morin | 24/205.13 R |
| 3,087,200 | 4/1963 | Morin | 24/205.1 R |
| 3,161,933 | 12/1964 | Doelter | 24/205.13 R |
| 3,886,634 | 6/1975 | Murata | 24/205.1 R |
| 3,964,137 | 6/1976 | Kihara | 24/205.13 D |

FOREIGN PATENT DOCUMENTS

| | | | |
|---|---|---|---|
| 267,801 | 6/1962 | Australia | 24/205.1 R |
| 2,350,168 | 10/1973 | Germany | 24/205.13 R |
| 1,179,923 | 2/1970 | United Kingdom | 24/205.13 D |

*Primary Examiner*—Bernard A. Gelak
*Attorney, Agent, or Firm*—O'Brien & Marks

[57] ABSTRACT

An invisible slide fastener includes thermoplastic slide fastener elements secured to folded-back portions of the mounting tapes. The slide fastener elements are molded onto the tapes so that integral fastening extensions of the fastener elements extend through an open mesh area of each tape. The slide fastener elements include an interlock structure which is particularly resistant to movement between the opposite rows of slide fastener elements.

6 Claims, 6 Drawing Figures

FIG. 1
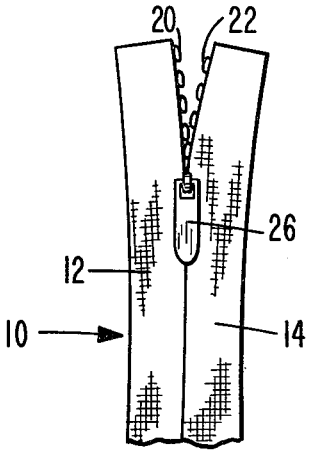
FIG. 2
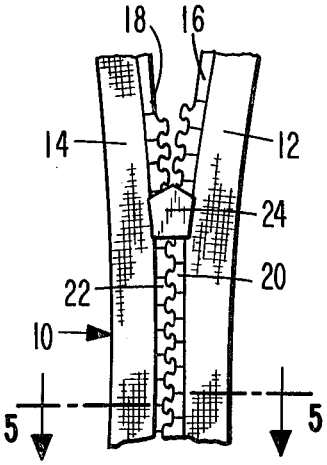
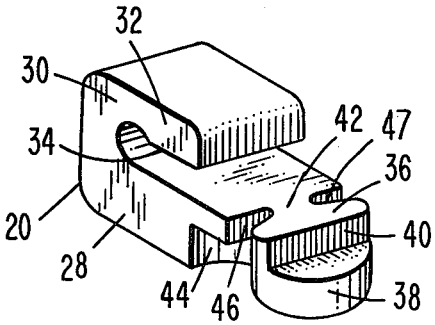
FIG. 3
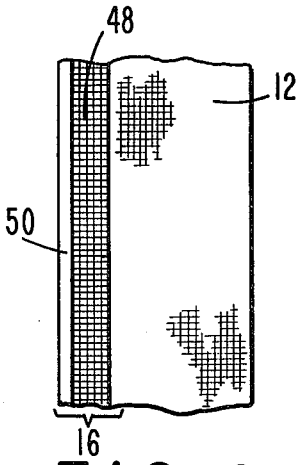
FIG. 4
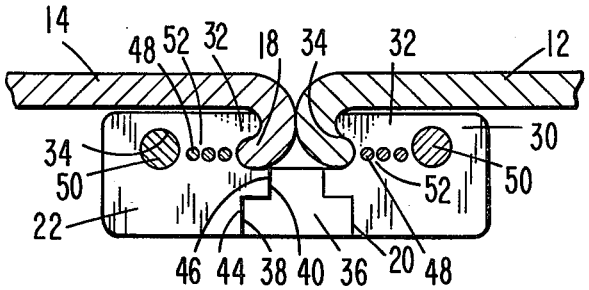
FIG. 5

SLIDE FASTENER

BACKGROUND OF THE INVENTION

1. Field of the Invention

The present invention relates to slide fasteners and particularly to slide fasteners of the invisible or hidden type and to such fasteners in which thermoplastic molded slide fastener elements are utilized.

2. Description of the Prior Art

It has been previously known in the art that slide fastener elements can be molded onto the edges of mounting tapes and the edges of the tapes folded to create a hidden or invisible slide fastener. One example of such a slide fastener is described in U.S. Pat. No. 3,124,871. A second example of a hidden slide fastener in which the coupling elements are molded on the edge of a tape which is then folded is shown in U.S. Pat. No. 3,192,566.

SUMMARY OF THE INVENTION

The present invention is summarized in that a slide fastener includes a pair of mounting tapes disposed adjacent each other, an open mesh area in each tape near the edge of the tape adjacent the opposite tape, a plurality of thermoplastic slide fastener elements on each tape adapted to couple with the slide fastener elements on the opposite tape, a main body of each slide fastener element on one side of the open mesh area of each tape, a fastening leg of each slide fastener element on the opposite side of the open mesh area of each tape, and fastening means integrally formed in each slide fastener element for connecting the fastening leg to the main body through the open mesh area for securing each slide fastener element to the tape.

An object of the present invention is to construct a slide fastener in which the slide fastener elements are integrally attached to the tapes in a novel and efficient manner.

Another object of the present invention is to construct a slide fastener in which the interlocking structure between the slide fastener elements is particularly adapted to prevent relative movement between the slide fastener elements on opposite tapes.

Yet another object of the invention is to provide such a slide fastener that can be easily, efficiently and economically manufactured.

Other objects, features, and advantages of the present invention will become apparent from the following description when taken in conjunction with the accompanying drawings.

BRIEF DESCRIPTION OF THE DRAWINGS

FIG. 1 is a front elevation view of a slide fastener according to the present invention.

FIG. 2 is a rear elevation view of the slide fastener of FIG. 1.

FIG. 3 is a perspective view of a slide fastener element of the slide fastener of FIG. 1.

FIG. 4 is a front elevation view of a mounting tape of the slide fastener of FIG. 1.

FIG. 5 is a cross-sectional view along the line 5—5 in FIG. 2.

DESCRIPTION OF THE PREFERRED EMBODIMENT

Figure 6:
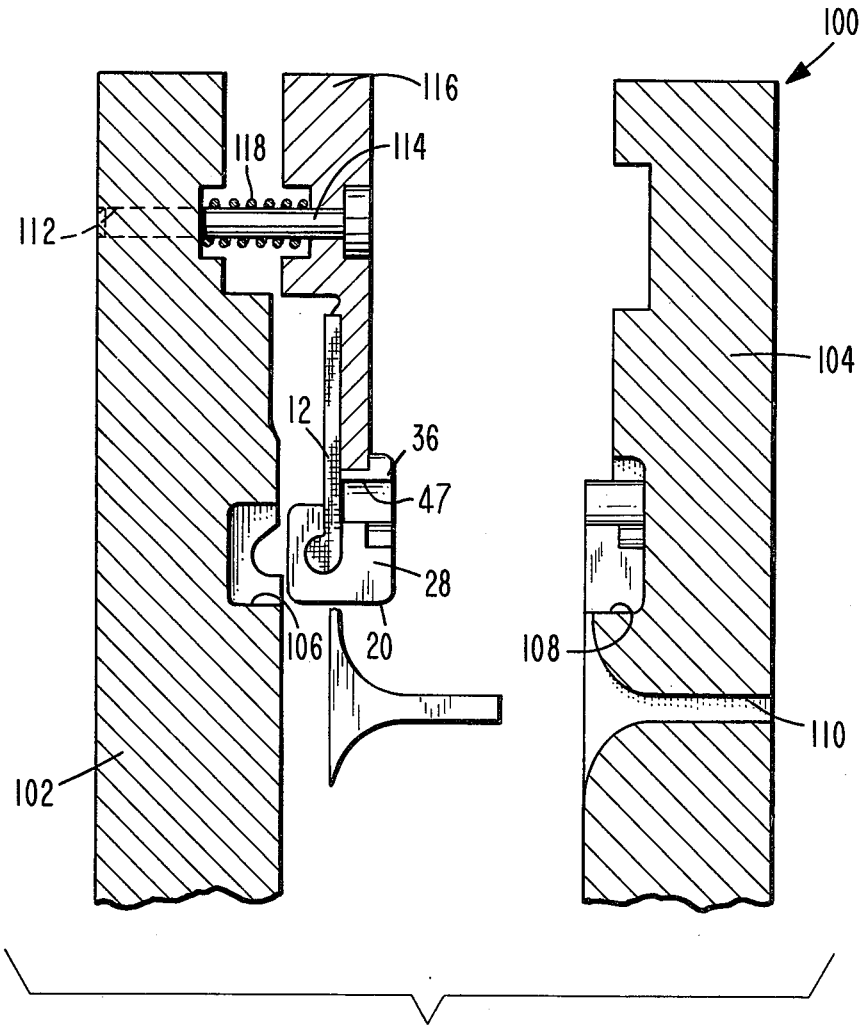
FIG. 6 is a sectional view of an apparatus for making the slide fastener of FIG. 1.

As shown in FIGS. 1 and 2, the present invention is embodied in a slide fastener, generally indicated at 10, of the type generally known as a hidden or invisible slide fastener. The fastener 10 includes a pair of mounting tapes 12 and 14 which lie adjacent each other and have their inner adjacent edges folded back to form folded portions 16 and 18. Secured to the folded portions 16 and 18 of the mounting tapes 12 and 14 are a plurality of interlocking thermoplastic slide fastener elements 20 and 22. A slider 24 having a pull tab 26 is entrained on the slide fastener elements 20 and 22 to control the interengaging therebetween. As seen in FIG. 1, only the pull tab 26 is visible between the mounting tapes 12 and 14 when the slide fastener is closed.

The tape 12 and elements 20 form a left stringer while the tape 14 and elements 22 form a right stringer; the left and right stringers together forming a chain of the slide fastener.

In FIG. 3, a single one of the slide fastener elements 20 is shown. Inasmuch as all of the slide fastener elements 20 and 22 are identical, the description of the detailed structure of the slide fastener element 20 of FIG. 3 should be understood to apply to all of the slide fastener elements 20 and 22. The slide fastener element 20 of FIG. 3 has a main body 28 which has generally flat upper and lower surfaces and which is generally rectangular in shape. A fastening leg 30 extends upward from the upper surface of the main body 28 and is bent at approximately a right angle to extend further parallel to the upper surface of the main body 28 before it terminates in a fastening heel 32. A channel 34 is defined between the fastening leg 30 and the main body 28. In front of the main body 28 is an interlocking head member 36. The head member 36 has upper and lower flat surfaces similar to the main body 28 but on its other surfaces has a generally rounded configuration. A rounded convex front surface 38 formed on the lower half of the front edge of the head member 36 is broken by a front shelf 40 in the form of a ledge or groove cut into the front of the head member 36 along its upper side. Joining the head member 36 to the main body 28 is a neck 42. The lower half of the main body 28 adjacent the neck 42 is formed into a concave rounded rear surface 44 of a curvature matching the curvature of the front surface 38 of the head member 36. Extending from the upper half of the main body 28 adjacent and on either side of the neck 42 are rear shelves 46. The rear shelves 46 are formed as ledges or extensions of the upper part of the main body 28. All the features of the slide fastener element 20 are integrally formed thereon when the thermoplastic material is molded to form the slide fastener element, as will be shown. Further the head member 36 has a rear surfaces 47 (see also FIG. 6) on opposite sides of the neck 42 which extend perpendicular to the mounting tapes continuously throughout the width of the head member 36 between its upper and lower surfaces.

The details of the mounting tape 12 are shown in FIG. 4, and since the mounting tape 14 is identical to the mounting tape 12, this description of the mounting tape 12 should be understood as applying equally to the mounting tape 14. In FIG. 4, the mounting tape 12 is unfolded but the folded portion 16 is indicated and the brackets show how much of the mounting tape 12 is included in the fold. The mounting tape 12 may be of any suitable textile fabric and may be knitted or woven. Formed integrally in the mounting tape 12, inside the area included in the folded portion 16 and adjacent the edge of the tape, is an open mesh area 48. The open mesh area 48 may be formed in any of many ways known to the art such as bringing only a small percentage of the weft threads of the weave through the open mesh area 48 or by including in a knit tape an area of warp yarn smaller than that in the rest of the tape. Regardless of how it is manufactured, the open mesh area 48 is an area in which the fabric is much wider in weave of knit so that the interstices between the threads or yarns are much greater than in the balance of the tape. At the very edge of the mounting tape 12, a small cord 50 is incorporated into the tape. The cord 50 can be woven or knitted into the tape or can be secured to the tape in any of the many other manners well known to the art.

The attachment of the slide fastener elements 20 and 22 to the mounting tapes 12 and 14 can be seen best in FIG. 5. The ends of the folded portions 16 and 18 are received inside the channels 34. In fact, inasmuch as the slide fastener elements 20 and 22 are molded directly onto the mounting tapes 12 and 14, as will be shown, the channels 34 conform exactly to the folded portions 16 and 18. The cords 50 are received at the end of the channels 34 on the inside of the bend in the fastening legs 30. The main bodies 28 and the fastening legs 30 are therefore disposed on opposite sides of the folded portions 16 and 18 in the exact area of the open mesh areas 48. Integral connecting fastening extensions 52 extend from the fastening heel 32 through the open mesh area 48 of the tapes to connect with the upper surfaces of the main bodies 28 of the slide fastener elements 20 and 22 to interconnect the slide fastener elements to the open mesh areas 48. Thus the slide fastener elements 20 and 22 are integrally and permanently joined to the mounting tapes 12 and 14 by the fastening extensions 52 which form an integral fastening network molded exactly to the contours of the fabric in the open mesh areas 48. And the width of the fastening heels 32 makes it impossible, even ignoring the fastening extensions 52, for the elements to come off the tape, since the cords 50 cannot be brought through the channels 34. Thus a secure and more permanent fastening of the slide fastener elements to the mounting tapes is accomplished than was previously possible in similar type slide fasteners.

The interlocking of the slide fastener elements 20 and 22 can also be seen in FIG. 5. The head member 36 of the slide fastener element 20 can be seen as it abuts one of the slide fastener elements 22. The front shelf 40 of the slide fastener element 20 rests against the rear shelf 46 of the slide fastener element 22. Similarly the front surface 38 of the slide fastener element 20 rests abutting the rear surface 44 of the slide fastener element 22. It should be noted that inasmuch as the head member 36 of the slide fastener 20 is received between two of the slide fastener elements 22, the front shelf 40 and the front surface 38 of a single one of the slide fastener elements 20 rests against the combined rear shelves 46 and rear surfaces 44 of an adjacent pair of the slide fastener elements 22. Similarly the head member 36 of each of the slide fastener elements 22 is received between the head members 36 of an adjacent pair of the slide fastener elements 20 with the front shelf 40 and the front surface 38 of the slide fastener element 22 abutting the combined rear shelves 46 and rear surfaces 44 of the adjacent pair of the slide fastener elements 22. Thus a tight and secure interlock is achieved between the tapes 12 and 14 by the slide fastener elements 20 and 22. The contact between the front surfaces 38 of the slide fastener elements 20 and the rear shelves 46 of the slide fastener elements 22 prevents the slide fastener elements 20 from moving upward relative to the slide fastener elements 22 to break the interlock. Similarly the front surfaces 38 of the slide fastener elements 22 and the rear shelves 46 of the slide fastener elements 20 prevent the slide fastener elements 22 from being moved upward relative to the slide fastener elements 20. In this way, an efficient and simple slide fastener can be constructed relatively simply and in an advantageous manner not previously possible.

An apparatus, generally indicated at 100, for making the slide fastener elements, here one of the slide fastener elements 20, of FIGS. 1–5 is shown in FIG. 6. The apparatus 100 includes a pair of mold forms, a stationary mold form 102 and a movable mold form 104. The mold form 102 has formed on its interior surface a stationary mold cavity 106 shaped specifically to conform to the desired shape of the fastening leg 30 of the slide fastener element 20. Similarly the mold form 104 has formed on its interior surface a movable mold cavity 108 shaped specifically to conform to the desired shape of the main body 28 and the head member 36. A material inlet 110 is formed through the movable form 104 and is in communication with the movable cavity 108. A bore 112 is defined in the stationary form 102 and receives therein a shaft 114 which extends from a core member 116. A spring 118 is disposed around the shaft 114 to bias the core member 116 away from the stationary form 102. The lower edge of the core member 116 is shaped and positioned to form the front shelf 40 of the slide fastener element 20. The mounting tape 12 is received between the core member 116 and the stationary form 102.

In the operation of the apparatus 100 of FIG. 6, the mounting tape 12 is first positioned between the core member 116 and the stationary form 102. Then the movable form 104 is moved toward the stationary form 102. The core member 116 is caught between the movable form 104 and the stationary form 102 and is pressed against the stationary form 102 with the spring 118 being compressed as the shaft 114 slides in the bore 112. When the movable form 104 and the stationary form 102 are joined together, molten thermoplastic material is injected into the material inlet 110. The molten thermoplastic material is molded into the shape of the slide fastener element 20. The fastening extensions 52 are formed at this time as the material flows into the holes in the open mesh area 48 of the mounting tape 12. In this way the slide fastener elements 20 and 22 can be easily, cheaply and efficiently manufactured and at the same time integrally and securely mounted on the mounting tape 12. The flash extending from the completed slide fastener 20 of FIG. 6 corresponds to the shape of the material inlet 110 and can be later removed in any of many conventional manners.

After the slide fastener elements 20 and 22 are molded onto the tapes 12 and 14 in the apparatus 100, the tapes 12 and 14 are removed from the apparatus, the flash is removed and the tapes folded to create the folded portions 16 and 18. Then the addition of the slider 24 creates a working slide fastener.

Inasmuch as the present invention is subject to many variations, modifications and changes in detail, it is intended that all material in the foregoing description or in the accompanying drawings be interpreted as illustrative and not in a limiting sense.

What is claimed is:

1. An invisible-type slide fastener chain comprising a pair of mounting tapes disposed adjacent each other with respective longitudinal portions extending from the inner edges of the tapes being folded back underneath the tapes;

a pair of pluralities of thermoplastic slide fastener elements molded on the folded-back portions of the respective tapes;

said fastener elements each having a main body beneath the folded-back portion, a leg extending upward from the main body past the inner edge of the respective tape and over the respective folded-back portion inside the fold formed thereby, a neck extending from the front of the main body, and a head member joined by the neck in front of the main body;

each of said head members having a front shelf formed on the front edge thereof and extending parallel the tapes;

said front shelf being in the form of a ledge cut into the upper portion of the front of the head member;

each of said main bodies having a rear shelf formed on the front edge thereof and extending parallel the tapes for engaging a portion of the front shelf of an element on the opposite tape;

said rear shelf being in the form of an extension of the upper portion of the main body adjacent both sides of the neck;

each of said head members further having rear engaging surfaces on opposite sides of the neck; and said engaging surfaces being perpendicular to the tapes and extending continuously through the full width of the head member for engaging the engaging surfaces of elements on the opposite tape.

2. A slide fastener chain as claimed in claim 1 wherein the side and front surfaces of each of the head members have a generally rounded configuration.

3. A slide fastener chain as claimed in claim 2 wherein each head member includes at its front end a rounded convex front surface along the lower portion thereof and the front shelf.

4. A slide fastener chain as claimed in claim 3 wherein there is a rounded concave rear surface formed in a lower portion of the main body beneath the rear shelf on each side of the neck.

5. A slide fastener chain as claimed in claim 1 wherein there is an open mesh area formed in each tape, a fastening heel is provided on each of the fastening legs adjacent the open mesh area of the tape and on the opposite side of the open mesh area from the main body, and fastening extensions are integrally formed on each slide fastener element connecting the fastening heel to the main body through the open mesh area of the tape to secure the slide fastener elements to the tape.

6. A slide fastener chain as claimed in claim 5 wherein the main body and the fastening heel of each element define a channel therebetween and wherein a cord is secured to the inner edges of the tapes, the channel being smaller than the cord so that the tapes cannot be withdrawn from the channels.

* * * * *